US007586053B2

(12) United States Patent
Kim et al.

(10) Patent No.: US 7,586,053 B2
(45) Date of Patent: Sep. 8, 2009

(54) SELECTION MEMBER COUPLING APPARATUS FOR CLOTHING HANDLER AND COUPLING METHOD THEREOF

(75) Inventors: Hyo-Jin Kim, Gyeongsangnam-Do (KR); Ho-Sung Jang, Gyeongsangnam-Do (KR); Jae-Cheol Lyu, Gyeongsangnam-Do (KR); Han-Ki Cho, Gyeongsangnam-Do (KR); Chang-Woo Son, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/105,348

(22) Filed: Apr. 18, 2008

(65) Prior Publication Data

US 2008/0257697 A1 Oct. 23, 2008

(30) Foreign Application Priority Data

Apr. 20, 2007 (KR) ..... 10-2007-0039030

(51) Int. Cl.
*H01H 9/18* (2006.01)

(52) U.S. Cl. ..... 200/296; 200/310; 200/317

(58) Field of Classification Search ..... 200/5 R, 200/5 A, 310–317, 341–345, 296
See application file for complete search history.

(56) References Cited

U.S. PATENT DOCUMENTS 6,667,447 B2 * 12/2003 Liu et al. ..... 200/5 R
6,743,993 B1 * 6/2004 Clark et al. ..... 200/314
6,965,511 B2 * 11/2005 Rudd et al. ..... 361/680
6,969,815 B1 * 11/2005 Lu ..... 200/345
7,129,432 B2 * 10/2006 Fujii et al. ..... 200/314
7,129,433 B2 * 10/2006 Tokusashi ..... 200/344
7,173,201 B2 * 2/2007 Fukaya et al. ..... 200/6 A
7,189,932 B2 * 3/2007 Kim ..... 200/5 R
7,241,960 B2 * 7/2007 Gill et al. ..... 200/517
7,414,216 B2 * 8/2008 Chiu et al. ..... 200/520

FOREIGN PATENT DOCUMENTS

KR 10-2005-0086199 A 8/2005
KR 10-2005-0089599 A 9/2005

OTHER PUBLICATIONS

Korean Office Action dated Aug. 29, 2008.

* cited by examiner

*Primary Examiner*—Michael A Friedhofer
(74) *Attorney, Agent, or Firm*—KED & Associates, LLP

(57) ABSTRACT

A selection member coupling apparatus for a clothing handler and an associated coupling method are provided. The selection member coupling apparatus may include a selection member, and a selection member guiding member that guides operation of the selection member through a front surface to which the selection member is coupled. A plurality of light emitting devices emit light through a transparent window coupled to the selection member guiding member based on options selected using the selection member.

17 Claims, 5 Drawing Sheets

SELECTION MEMBER COUPLING APPARATUS FOR CLOTHING HANDLER AND COUPLING METHOD THEREOF

BACKGROUND OF THE INVENTION

1. Field of the Invention

The present invention relates to a clothing handler, and more particularly, to a selection member coupling apparatus for a clothing handler and a coupling method thereof.

2. Description of the Related Art

Clothing handlers serve to perform each kind of process for clothing and include washing machines, dryers and so on.

The clothing handler is provided with a control panel. The control panel includes a plurality of buttons for applying a power and inputting options for handling clothing, and a plurality of LED (Light Emitting Diode) devices emitting light so as to display a function corresponding to a selected button. And, in order to protect the LED devices from an outside, a plurality of transparent windows covering each LED device are installed.

However, in the related clothing handler, since each transparent window covering each LED device is small, light emitting efficiency of the LED devices is deteriorated and a user cannot easily recognize whether or not light is emitted from a corresponding LED device.

SUMMARY OF THE INVENTION

Therefore, the present invention is directed to providing a selection member coupling apparatus for a clothing handler in which a structure of a transparent window covering light emitting devices is enhanced and to a coupling method thereof, so as to easily recognize whether or not light is emitted from the light emitting devices.

To achieve these and other advantages and in accordance with the purpose of the present invention, as embodied and broadly described herein, there is provided a selection member coupling apparatus for a clothing handler, the apparatus comprising: a selection member for selecting options for handling clothing, a selection member guiding member for guiding an operation of the selection member by having a front surface to which the selection member is coupled, a plurality of light emitting devices for emitting light according to an option selected by the selection member, and a transparent window coupled to the selection member guiding member with covering the plurality of light emitting devices.

In accordance with another aspect of the present invention, there is provided a selection member coupling apparatus for a clothing handler, the apparatus comprising: a selection member movably installed at a body of the clothing handler, a selection member guiding member for guiding motion of the selection member, a light emitting device for emitting light according to an option selected by the selection member, and a transparent window coupled to the selection member guiding member with covering the light emitting device.

In accordance with one aspect of the present invention, there is provided a coupling method of a selection member coupling apparatus for a clothing handler, in the selection member coupling apparatus comprising a selection member, a selection member guiding member, a plurality of light emitting devices and a transparent window, the method comprising: coupling the selection member to the selection member guiding member, and coupling the transparent window to the selection member guiding member so as for the transparent window to cover the plurality of light emitting devices.

In the selection member coupling apparatus for the clothing handler and the coupling method thereof in accordance with one aspect of the present invention, since the buttons and the transparent window are solidly coupled to the button guiding member and the transparent window covers the plurality of light emitting devices, it is capable of enlarging an area of the transparent window allocated to each light emitting device. Accordingly, the amount of light outwardly transmitted may be increased, thereby being capable of easily recognizing whether or not the light emitting devices emit light from the outside.

Further, in the selection member coupling apparatus for the clothing handler and the coupling method thereof in accordance with another aspect of the present invention, since the mis-assembly preventing protrusions and the mis-assembly preventing holes are formed to be coupled to each other, it is capable of preventing mis-assembly of the buttons when the buttons are respectively coupled to the button guiding member. Accordingly, it is capable of reducing time and costs spent on a process for fixing the mis-assembly of the buttons and of preventing mal-operation of the clothing handler resulting from selecting a mis-assembled button.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate preferred embodiments of the invention and together with the description serve to explain the principles of the invention.

In the drawings.

DETAILED DESCRIPTION OF THE INVENTION

Hereafter, description will now be given in detail of the preferred embodiments of the present invention, examples of which are illustrated in the accompanying drawings.

Here, a selection member coupling apparatus for a clothing handler and a coupling method thereof in accordance with the present invention is disclosed to be applied to a control panel of a clothing handler, however, it may be applied to other components of the clothing handler.

Figure 1:
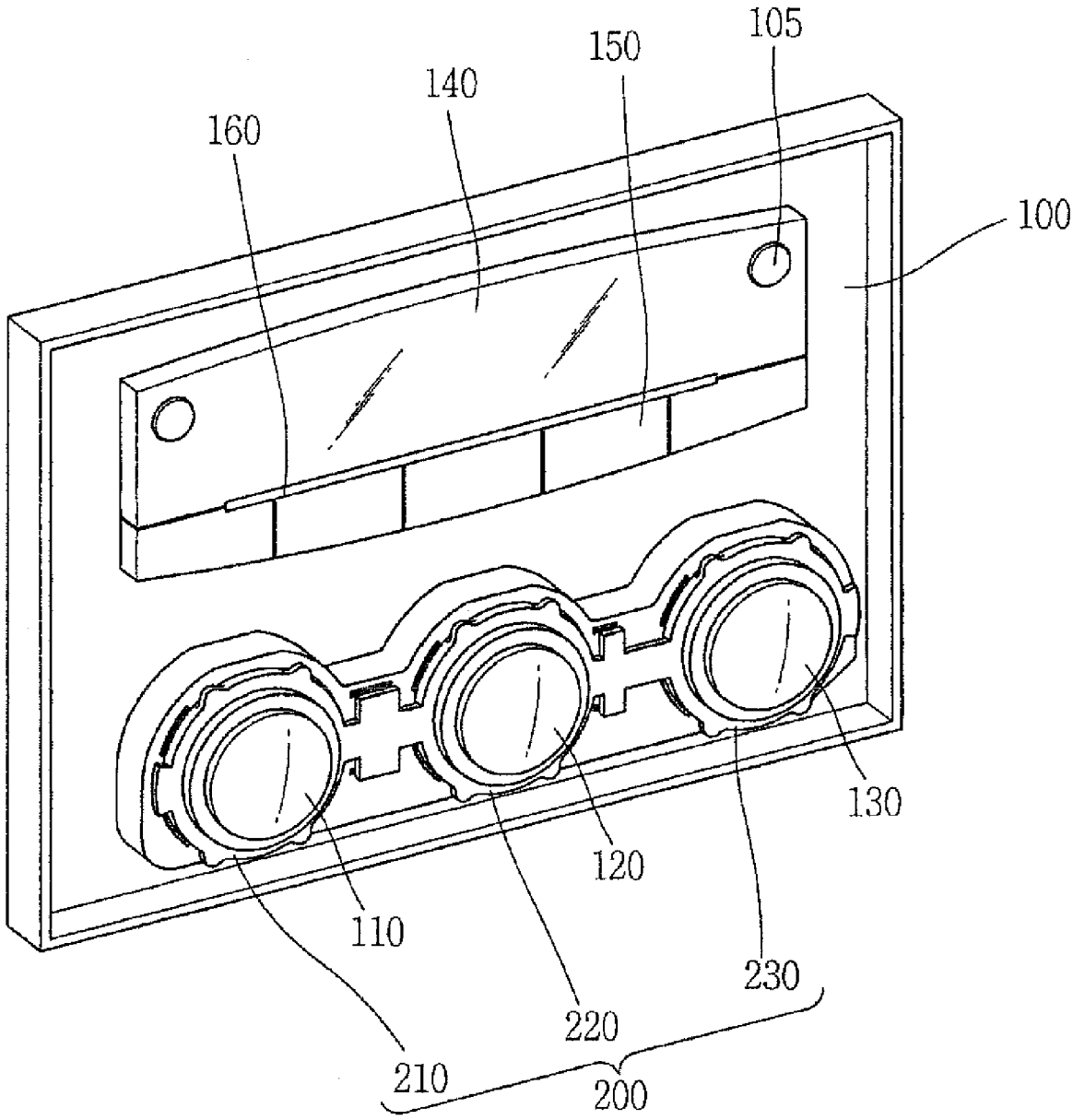
FIG. 1 is a front perspective view showing a control panel of a clothing handler having a selection member coupling apparatus in accordance with one embodiment of the present invention.
Figure 2:
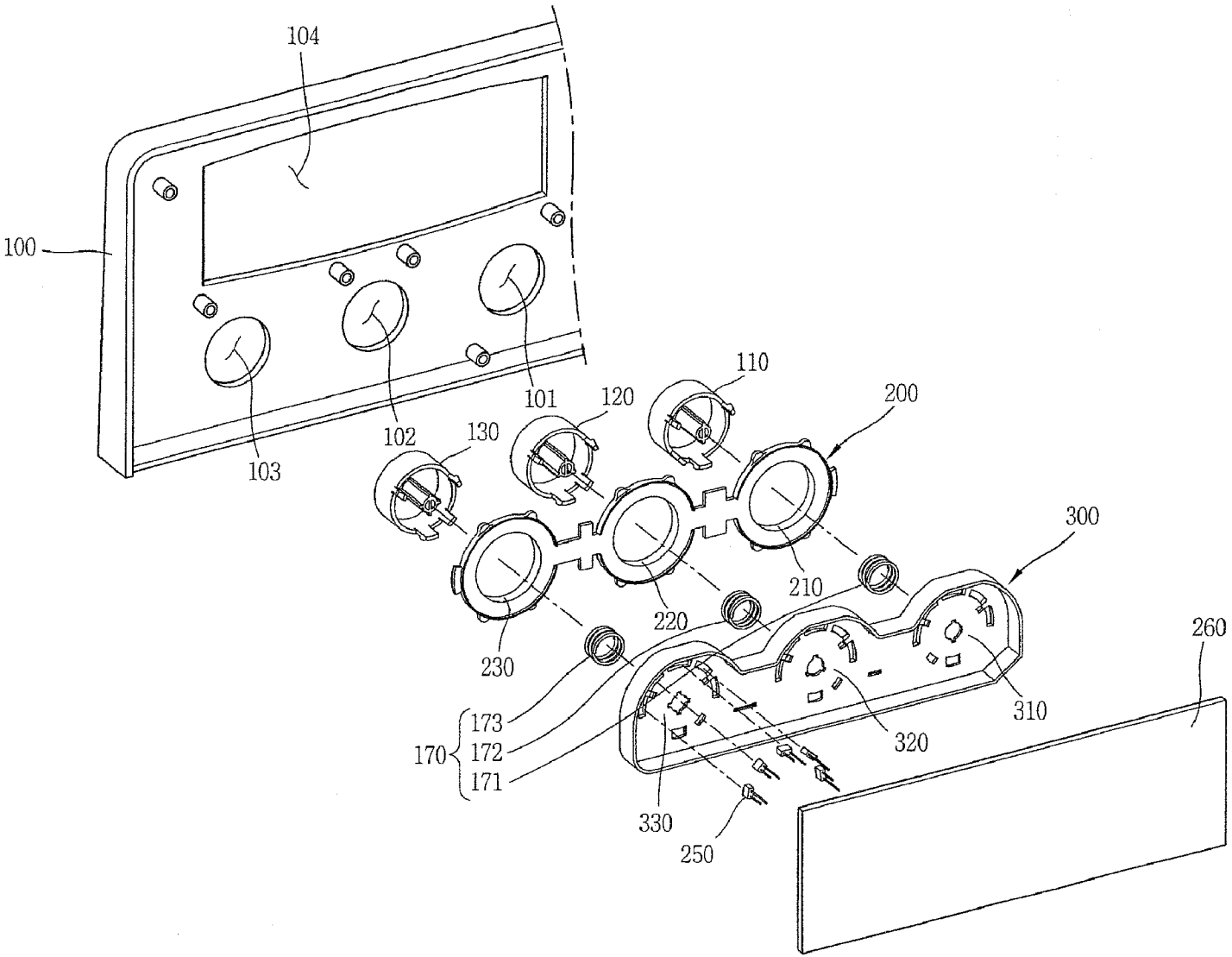
FIG. 2 is an exploded rear perspective view showing the selection member coupling apparatus in accordance with the one embodiment of the present invention.

FIG. 1 is a front perspective view showing a control panel of a clothing handler having a selection member coupling apparatus in accordance with one embodiment of the present invention, and FIG. 2 is an exploded rear perspective view showing the selection member coupling apparatus in accordance with the one embodiment of the present invention.

Referring to FIGS. 1 and 2, a selection member coupling apparatus of this embodiment may be installed on a control panel 100 of the clothing handler. A substrate unit 260 on which various circuits are formed is disposed at a rear side of the control panel 100. Reference numerals 140 and 150 indicate a display window and rectangular buttons disposed at an upper side of the selection member coupling apparatus on the control panel 100.

The selection member coupling apparatus includes circular buttons 110, 120, 130, a transparent window 200, a button guiding member 300, and a plurality of light emitting devices 250.

Particularly, the circular buttons consist of a first circular button 110, a second circular button 120 and a third circular button 130. Options for handling clothing may be inputted by each circular button 110, 120, 130 and each corresponding portion of the substrate unit 260, respectively. And, the number of times each circular button 110, 120, 130 is pressed may determine options to be inputted for handling clothing.

The circular buttons 110, 120, 130 may be defined as a selection member for selecting various options for handling clothing, for example, applying of power, selecting of a course, etc. in the clothing handler. According to the number of times the circular buttons 110, 120, 130 are pressed by a user, a corresponding option is selected.

The control panel 100 is provided with insertion holes 101, 102, 103 into which the circular buttons 110, 120, 130 are respectively inserted to be operated.

The plurality of light emitting devices 250 can emit light separately or collectively. Each of the plurality of light emitting devices 250 is disposed at each periphery of the circular buttons 110, 120, 130 in a group, respectively.

The light emitting devices 250 are controlled to emit light according to the number of times the corresponding one of circular buttons 110, 120, 130 is pressed. The emitting of light may be implemented as a manner that one light emitting device 250 corresponding to the number of times the corresponding one of circular buttons 110, 120, 130 is pressed emits light and a manner that the light emitting devices 250 emit light accumulatively corresponding to the number of times the corresponding one of circular buttons 110, 120, 130 is pressed. Here, the manner accumulatively emitting light may include a manner that the light emitting devices 250 consecutively emit light as the number of times the button is pressed is increased.

The transparent window 200 consists of a first button window 210, a second button window 220 and a third button window 230. The button windows 210, 220, 230 are connected to each other, thus implement a single transparent window 200. The transparent window 200 covers the plurality of light emitting devices 250. Thus, it may facilitate disposing of the light emitting devices 250 and the transparent window 200, and a coupling structure therebetween may be simple.

Each of the circular buttons 110, 120, 130 penetrates each of the button windows 210, 220, 230 of the transparent window 200 to be operated. And, a protruded front portion of each button window 210, 220, 230 and each circular button 110, 120, 130 are respectively inserted into the insertion holes 101, 102, 103, thus may be outwardly exposed.

The button guiding member 300 guides an operation of each circular button 110, 120, 130 so as to facilitate a pressing operation for the circular buttons 110, 120, 130. The button guiding member 300 consists of a first button guiding unit 310, a second button guiding unit 320 and a third button guiding unit 330. The button guiding member 300 can be defined as a selection member guiding member.

The circular buttons 110, 120, 130 are coupled to the front surface of the button guiding member 300. And, the transparent window 200 is coupled to the front surface of the button guiding member 300 with covering the plurality of light emitting devices 250.

In order to facilitate the coupling process, after the circular buttons 110, 120, 130 are coupled to the button guiding member 300, the transparent window 200 may be coupled to the button guiding member 300 with covering the plurality of light emitting devices 250.

The light emitting devices 250 may be installed at a rear side of the button guiding member 300 toward a front side thereof.

A spring unit 170, an elastic member, is mounted between the button guiding member 300 and the circular buttons 110, 120, 130. After released from pressing for the circular buttons 110, 120, 130, the spring unit 170 provides an elastic force so that the circular buttons 110, 120, 130 can be moved into its original positions.

Figure 3:
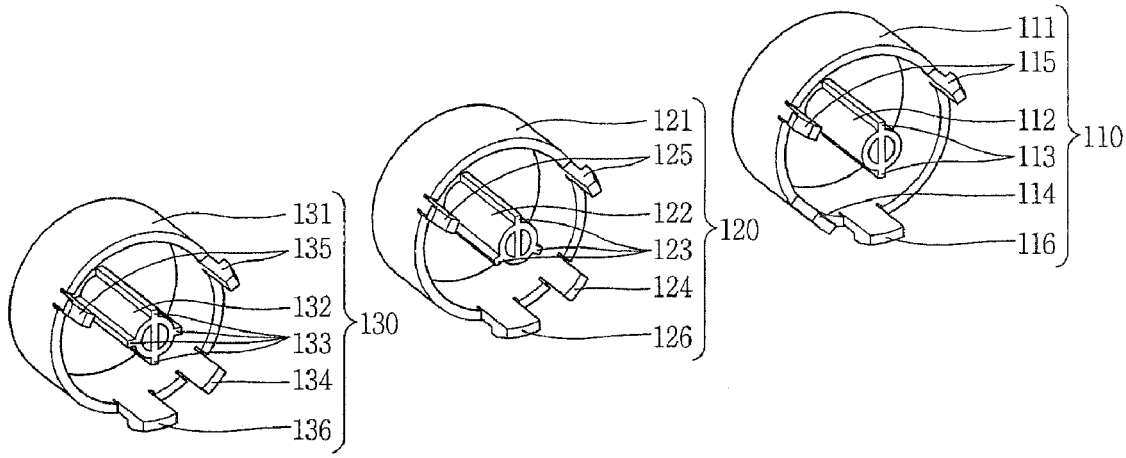
FIG. 3 is a rear perspective view showing circular buttons applied to the selection member coupling apparatus in accordance with the one embodiment of the present invention.

FIG. 3 is a rear perspective view showing circular buttons applied to the selection member coupling apparatus in accordance with the one embodiment of the present invention.

Referring to FIG. 3, the circular buttons 110, 120, 130 of this embodiment are respectively provided with button bodies 111, 121, 131, supporting shafts 112, 122, 132, first mis-assembly preventing protrusions 113, 123, 133, second mis-assembly preventing protrusions 114, 124, 134, upper coupling hooks 115, 125, 135, and lower coupling hooks 116, 126, 136.

Each button body 111, 121, 131 has a specific area so as to be pressed by the user.

Each supporting shaft 112, 122, 132 is extended from a rear middle portion of each button body 111, 121, 131, thus respectively inserted into specific portions of the button guiding member 300. The supporting shafts 112, 122, 132 support the button bodies 111, 121, 131, and guide motion of the button bodies 111, 121, 131 when the button bodies 111, 121, 131 are pressed.

The first mis-assembly preventing protrusions 113, 123, 133 are provided at the supporting shafts 112, 122, 132 with different positions and shapes from each other. The first mis-assembly preventing protrusions 113, 123, 133 may be provided at the supporting shafts 112, 122, 132 with the same position and shape to each other in a length direction thereof so as to be inserted into specific portions of the button guiding member 300 to be slidable.

As exemplarily shown in FIG. 3, the first mis-assembly preventing protrusion 113 may be protruded from the supporting shaft 112 of the first circular button 110 in a vertical direction. The first mis-assembly preventing protrusion 123 may be protruded from the supporting shaft 122 of the second circular button 120 in three directions at an interval of approximately 120° therebetween. And, the first mis-assembly preventing protrusion 133 may be protruded from the supporting shaft 132 of the third circular button 130 in four directions at an interval of approximately 90° therebetween.

The button guiding member 300 may be provided with protrusion penetrating holes having shapes corresponding to the first mis-assembly preventing protrusions 113, 123, 133, respectively. Thus, when coupling the circular buttons 110, 120, 130 to the button guiding member 300, each of the first mis-assembly preventing protrusions 113, 123, 133 is coupled to the corresponding protrusion penetrating hole, thereby being capable of preventing the circular buttons 110, 120, 130 from being mis-assembled. Accordingly, it is capable of reducing time and costs spent on a process for fixing mis-assembly of the circular buttons 110, 120, 130, thereby being capable of preventing mal-operation of the clothing handler resulting from selecting a mis-assembled button.

The second mis-assembly preventing protrusions 114, 124, 134 are respectively formed at positions spaced from the supporting shafts 112, 122, 132 by a specific distance, for example, edge portions of each button body 111, 121, 131. The second mis-assembly preventing protrusions 114, 124, 134 are formed at different positions with different shapes so as to prevent the circular buttons 110, 120, 130 from being mis-assembled.

As exemplarily shown in FIG. 3, each second mis-assembly preventing protrusion 114, 124, 134 may be formed on different hemispheres of the circular buttons 110, 120, 130 when each circular button 110, 120, 130 is vertically partitioned based on a center thereof. The second mis-assembly preventing protrusions 114, 124, 134 may be formed at different positions on the same hemisphere.

The upper coupling hooks 115, 125, 135 and the lower coupling hooks 116, 126, 136 are coupled to upper hook coupling holes 315, 325, 335 (refer to FIG. 5) and lower hook coupling holes 317, 327, 337 (refer to FIG. 5), respectively, so as to prevent each circular button 110, 120, 130 from being separated from the button guiding member 300.

The upper coupling hooks 115, 125, 135 and the lower coupling hooks 116, 126, 136 are extended in the same shape and have extended ends formed in a hook shape, thereby facilitating sliding of the circular buttons 110, 120, 130 and preventing the circular buttons 110, 120, 130 from being arbitrarily separated.

And, the upper coupling hooks 115, 125, 135 and the lower coupling hooks 116, 126, 136 are respectively protruded from each edge portion of the button bodies 111, 121, 131 at an interval of approximately 120° therebetween, thereby being capable of guiding an operation of the circular buttons 110, 120, 130 as well as of preventing the separation.

Figure 4:
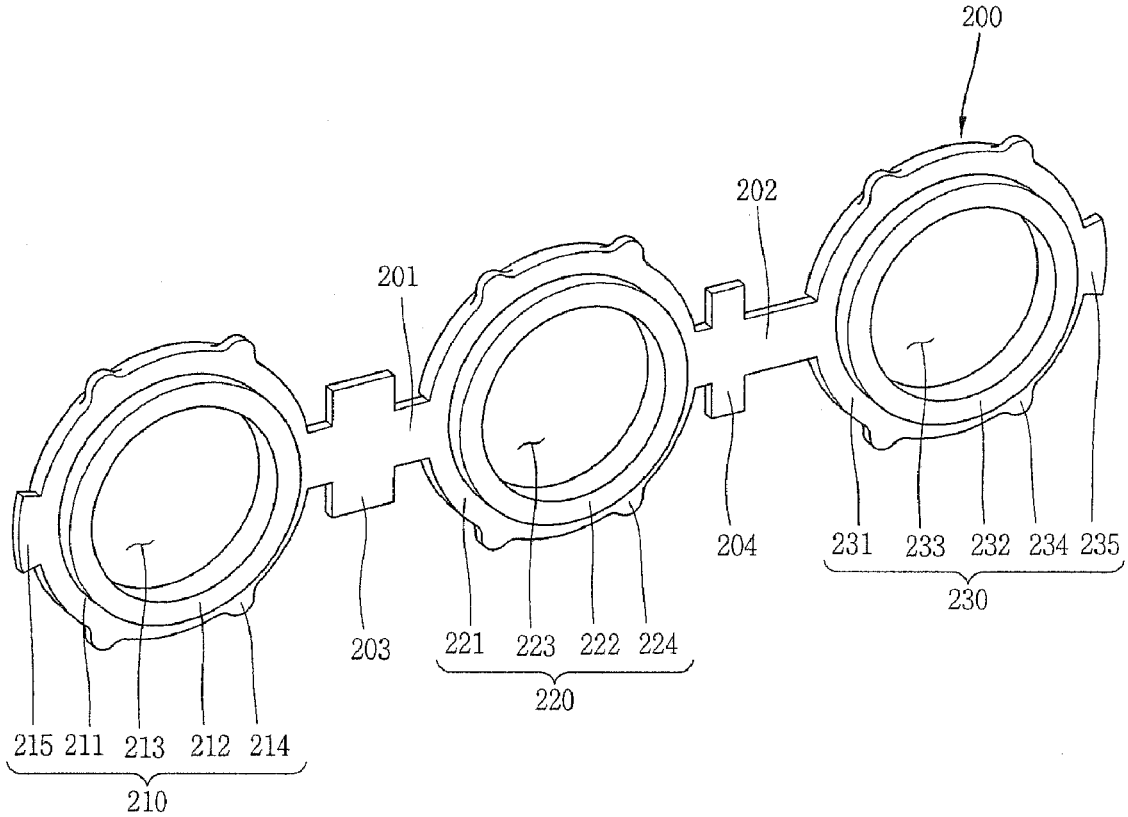
FIG. 4 is a front perspective view showing a transparent window applied to the selection member coupling apparatus in accordance with the one embodiment of the present invention.

FIG. 4 is a front perspective view showing the transparent window applied to the selection member coupling apparatus in accordance with the one embodiment of the present invention.

Referring to FIG. 4, the transparent window 200 of this embodiment includes a first button window 210, a second button window 220 and a third button window 230 connected to each other by a first connecting portion 201 and a second connecting portion 202.

Particularly, the first button window 210, the second button window 220 and the third button window 230 are respectively provided with button window bodies 211, 221, 231, integrated device covers 212, 222, 232, button penetrating holes 213, 223, 233, first locking protrusions 214, 224, 234, and second locking protrusions 215, 235.

The integrated device covers 212, 222, 232 are forwardly protruded from the button window bodies 211, 221, 231 and have rear sides provided with a plurality of light emitting devices 250 formed in a group, respectively. With such configuration, the integrated device covers 212, 222, 232 can cover the plurality of light emitting devices 250. Accordingly, an area of the transparent window 200 allocated to each light emitting device 250 may be enlarged, thereby being capable of increasing the amount of light outwardly transmitted and of implementing an excellent appearance. And, it is capable of facilitating handling for the transparent window 200 and of reducing time and costs spent on the coupling process.

The button penetrating holes 213, 223, 233 are portions through which each circular button 110, 120, 130 passes.

The first locking protrusions 214, 224, 234 and the second locking protrusions 215, 235 are locked to specific portions of the button guiding member 300 so as for the transparent window 200 to be mounted at the button guiding member 300. By the first locking protrusions 214, 224, 234 and the second locking protrusions 215, 225, 235, the transparent window 200 may be stable on the button guiding member 300.

Meanwhile, the first connecting portion 201 and the second connecting portion 202 are provided with a first window coupling protrusion 203 and a second window coupling protrusion 204. The first window coupling protrusion 203 and the second window coupling protrusion 204 are protruded in a direction different from an extended direction of the first connecting portion 201 and the second connecting portion 202, thus locked to specific portions of the button guiding member 300 so as to stably couple the transparent window 200.

And, the transparent window 200 may be formed to be semitransparent. Accordingly, light generated from the light emitting devices 250 is transmitted to an outside through the transparent window 200, thus the light emitting devices 250 cannot be shown at the outside, thereby being capable of implementing the excellent appearance.

Figure 5:
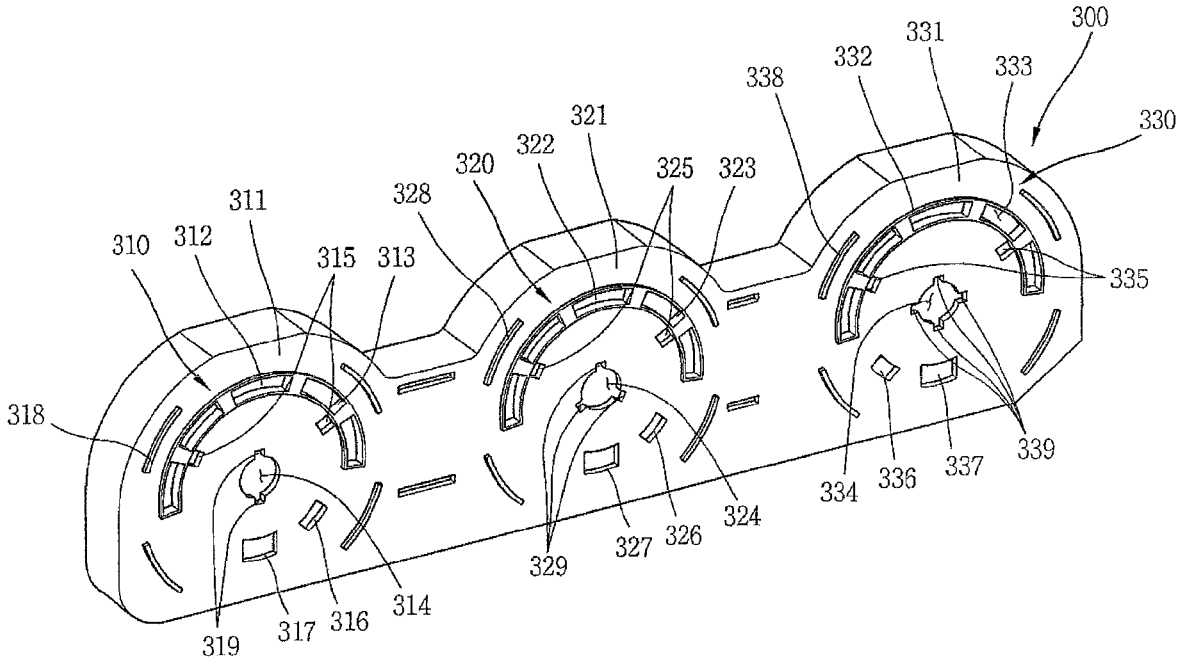
FIG. 5 is a perspective view showing a button guiding member applied to the selection member coupling apparatus in accordance with the one embodiment of the present invention.

FIG. 5 is a perspective view showing the button guiding member applied to the selection member coupling apparatus in accordance with the one embodiment of the present invention.

Referring to FIG. 5, the button guiding member 300 consists of a first guiding unit 310, a second guiding unit 320 and a third guiding unit 330.

Each guiding unit 310, 320, 330 respectively consists of guiding unit bodies 311, 321, 331, light emitting hole protrusion portions 312, 322, 332, light emitting holes 313, 323, 333, supporting shaft penetrating holes 314, 324, 334, the upper hook coupling holes 315, 325, 335, second mis-assembly preventing holes 316, 326, 336, the lower hook coupling holes 317, 327, 337, mounting hole forming protrusions 318, 328, 338 and first mis-assembly preventing holes 319, 329, 339.

The light emitting hole protrusion portions 312, 322, 332 are respectively protruded from the guiding unit bodies 311, 321, 331 by specific heights and provided with a plurality of light emitting holes 313, 323, 333.

The light emitting devices 250 are disposed at each rear side of the light emitting holes 313, 323, 333, thus light generated from the light emitting devices 250 is outwardly transmitted through the light emitting holes 313, 323, 333.

The light emitting holes 313, 323, 333 are formed at the light emitting hole protrusion portions 312, 322, 332 to be spaced from each other by a specific distance with having partition walls therebetween so as to prevent interference between the lights.

In this embodiment, end portions protruded from the light emitting hole protrusion portions 312, 322, 332 are adjacent to the transparent window 200. Thus, light passing through the light emitting holes 313, 323, 333 of each light emitting hole protrusion portion 312, 322, 332 may not be interfered with each other. Accordingly, by integrally forming the transparent window 200, the area of the transparent window 200 allocated to each light emitting device 250 may be enlarged, thus it is capable of increasing the amount of light outwardly transmitted and of implementing the excellent appearance, and at the same time, interference between the light generated from each light emitting device 250 is prevented, thereby being capable of enhancing light emitting efficiency.

The supporting shaft penetrating holes 314, 324, 334 are portions through which the supporting shafts 112, 122, 132 of the circular buttons 110, 120, 130 pass, respectively.

The first mis-assembly preventing holes 319, 329, 339 are formed at each periphery of the supporting shaft penetrating holes 314, 324, 334. The first mis-assembly preventing holes 319, 329, 339 are formed at positions corresponding to the first mis-assembly preventing protrusions 113, 123, 133 of the circular buttons 110, 120, 130 with shapes corresponding thereto.

And, the second mis-assembly preventing holes 316, 326, 336 are formed at positions spaced from the supporting shaft penetrating holes 314, 324, 334 by specific distances. The second mis-assembly preventing holes 316, 326, 336 are formed at positions corresponding to the second mis-assembly preventing protrusions 114, 124, 134 of the circular buttons 110, 120, 130 with shapes corresponding thereto.

With such configuration, the first mis-assembly preventing protrusions 113, 123, 133 and the second mis-assembly preventing protrusions 114, 124, 134 may pass through the first mis-assembly preventing holes 319, 329, 339 and the second mis-assembly preventing holes 316, 326, 336, respectively. Thus, each circular button 110, 120, 130 can be coupled to each guiding unit 310, 320, 330 of the button guiding member 300 without mis-assembly.

Here, the first mis-assembly preventing protrusions 113, 123, 133, the second mis-assembly preventing protrusions 114, 124, 134, the first mis-assembly preventing holes 319, 329, 339, and the second mis-assembly preventing holes 316, 326, 336 may be defined as a mis-assembly preventing unit.

The upper coupling hooks 115, 125, 135 and the lower coupling hooks 116, 126, 136 of the circular buttons 110, 120, 130 are respectively coupled to the upper hook coupling holes 315, 325, 335 and the lower hook coupling holes 317, 327, 337. Accordingly, each circular button 110, 120, 130 can remain stably coupled to each guiding unit 310, 320, 330 of the button guiding member 300 without arbitrary separation.

The mounting hole forming protrusions 318, 328, 338 are protruded from each edge portion of the guiding units 310, 320, 330 by specific heights so as to form mounting holes. In the mounting holes, each button window body 211, 221, 231, each mounting portion of the transparent window 200, is mounted and locked.

Here, the first locking protrusions 214, 224, 234 and the second locking protrusions 215, 235 protruded from each button window body 211, 221, 231 are locked to the mounting hole forming protrusions 318, 328, 338.

With such configuration, it is capable of stably coupling the transparent window 200 to each guiding unit 310, 320, 330 of the button guiding member 300.

Here, the mounting hole forming protrusions 318, 328, 338, the button window bodies 211, 221, 231, the first window coupling protrusion 203 and the second window coupling protrusion 204 may be defined as a transparent window coupling unit.

Figure 6:
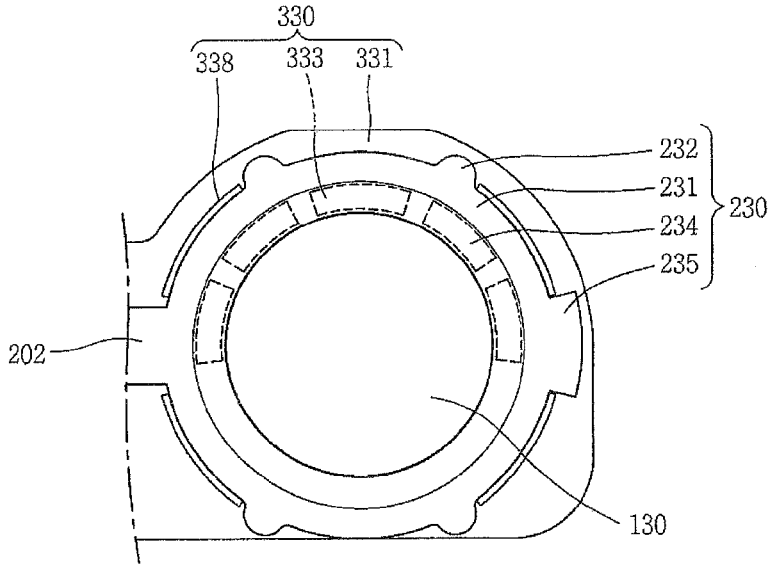
FIG. 6 is a front view showing a coupled state of the selection member coupling apparatus in accordance with the one embodiment of the present invention.

FIG. 6 is a front view showing a coupled state of the selection member coupling apparatus in accordance with the one embodiment of the present invention.

Referring to FIG. 6, in this embodiment, the third button window 230 of the transparent window 200 is coupled to the third guiding unit 330 of the button guiding member 300. This is merely exemplary and can be applied to other portions of the transparent window 200 and the button guiding member 300.

As shown, in accordance with this embodiment, the area of the transparent window 200 allocated to each light emitting device 250 may be enlarged and the transparent window 200 may be easily and solidly coupled to the button guiding member 300.

Figure 7:
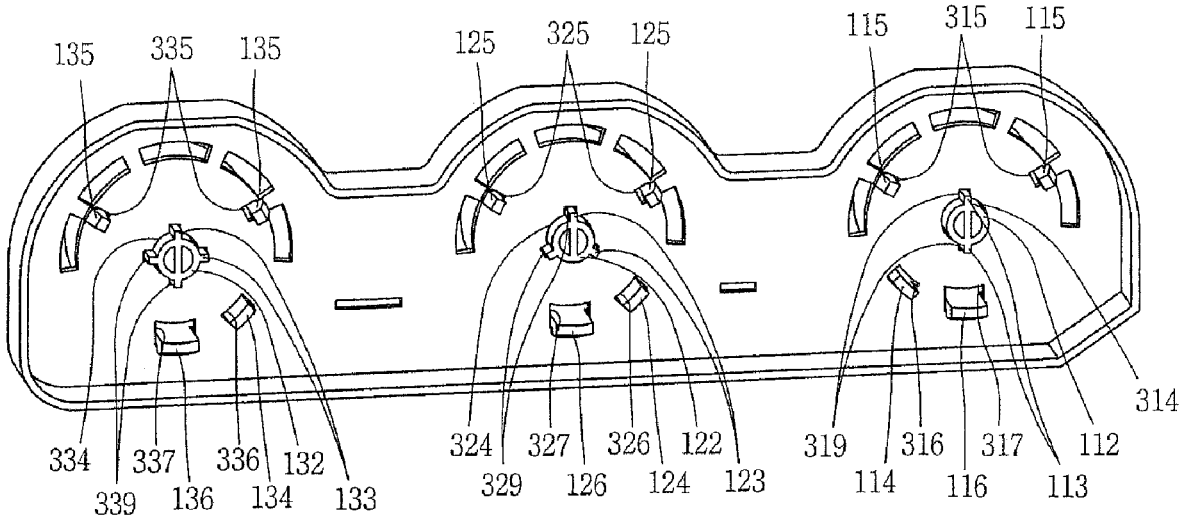
FIG. 7 is a rear view showing a coupled state of a button coupling apparatus in accordance with the one embodiment of the present invention.

FIG. 7 is a rear view showing a coupled state of a button coupling apparatus in accordance with one embodiment of the present invention.

Referring to FIG. 7, in the button coupling apparatus of this embodiment, the circular buttons 110, 120, 130 and the transparent window 200 are coupled to the button guiding member 300.

The supporting shafts 112, 122, 132 of the circular buttons 110, 120, 130 pass through the supporting shaft penetrating holes 314, 324, 334 of the button guiding member 300, respectively. And, the first mis-assembly preventing protrusions 113, 123, 133 pass through the first mis-assembly preventing holes 319, 329, 339 communicated with the supporting shaft penetrating holes 314, 324, 334, respectively. And, the second mis-assembly preventing protrusions 114, 124, 134 pass through the second mis-assembly preventing holes 316, 326, 336, respectively.

As exemplarily shown in FIG. 7, each pair of the first mis-assembly preventing holes 319, 329, 339 and the first mis-assembly preventing protrusions 113, 123, 133 is disposed at different positions with different shapes. And, each pair of the second mis-assembly preventing holes 316, 326, 336 and the second mis-assembly preventing protrusions 114, 124, 134 is disposed at different positions. Accordingly, it is capable of precisely coupling the circular buttons 110, 120, 130 to the button guiding member 300 without mis-assembly.

Hereafter, a coupling method of the selection member coupling apparatus in accordance with the one embodiment of the present invention.

First, the circular buttons 110, 120, 130 are coupled to the first to third guiding units 310, 320, 330 of the button guiding member 300. This coupling process can be implemented by coupling the upper coupling hooks 115, 125, 135 and the lower coupling hooks 116, 126, 136 formed at the circular buttons 110, 120, 130 to the upper hook coupling holes 315, 325, 335 and the lower hook coupling holes 317, 327, 337 formed at the first to third guiding units 310, 320, 330, respectively.

In the coupling process for the circular buttons 110, 120, 130, the first mis-assembly preventing protrusions 113, 123, 133 and the second mis-assembly preventing protrusions 114, 124, 134 formed at the circular buttons 110, 120, 130 are respectively coupled to the first mis-assembly preventing holes 319, 329, 339 and the second mis-assembly preventing holes 316, 326, 336 formed at the button guiding member 300, accordingly it is capable of coupling each circular button 110, 120, 130 to each guiding unit 310, 320, 330 of the button guiding member 300 without mis-assembly.

Additionally, in the coupling process for the circular buttons 110, 120, 130, springs 171, 172, 173 are disposed between the circular buttons 110, 120, 130 and the button guiding member 300, and then each supporting shaft 112, 122, 132 of the circular buttons 110, 120, 130 passes through each spring 171, 172, 173. Accordingly, by the springs 171, 172, 173 between the circular buttons 110, 120, 130 and the button guiding member 300, it is capable of providing an elastic force when the circular buttons 110, 120, 130 are operated.

Meanwhile, after coupling the circular buttons 110, 120, 130 to the button guiding member 300, the transparent window 200 is coupled to the button guiding member 300 so as to cover the plurality of light emitting devices 250. To this end, each button window body 211, 221, 231 of the transparent window 200 is mounted in the mounting holes formed by the mounting hole forming protrusions 318, 328, 338 of the button guiding member 300, and the first locking protrusions 214, 224, 234 and the second locking protrusions 215, 235 formed at the transparent window 200 are locked to the mounting hole forming protrusions 318, 328, 338.

In the selection member coupling apparatus for the clothing handler and the coupling method thereof in accordance with one aspect of the present invention, since the buttons and the transparent window are solidly coupled to the button guiding member and the transparent window covers the plurality of light emitting devices, it is capable of enlarging the area of the transparent window allocated to each light emitting device. Accordingly, the amount of light outwardly transmitted may be increased, thereby being capable of easily recognizing whether or not the light emitting devices emit light from the outside.

Further, in the selection member coupling apparatus for the clothing handler and the coupling method thereof in accordance with another aspect of the present invention, since the mis-assembly preventing protrusions and the mis-assembly preventing holes are formed to be coupled to each other, it is capable of preventing mis-assembly of the buttons when the buttons are respectively coupled to the button guiding member. Accordingly, it is capable of reducing time and costs spent on a process for fixing the mis-assembly of the buttons and of preventing mal-operation of the clothing handler resulting from selecting a mis-assembled button.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present inventive features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A selection member coupling apparatus for a clothing handler, the apparatus comprising:

a selection member that provides for selection of clothing handling options;

a selection member guiding member having a front surface to which the selection member is coupled, wherein the selection member guiding member guides operation of the selection member;

a plurality of light emitting devices that emit light based on a selected clothing handling option;

a transparent window coupled to the selection member guiding member so as to cover the plurality of light emitting devices; and a mis-assembly preventing device provided with corresponding portions of the selection member and the selection member guiding member so as to prevent mis-assembly of the selection member and the selection member guiding member, wherein the selection member includes a supporting shaft that extends back from a central portion thereof and the selection member guiding member includes a supporting shaft penetrating hole that receives the supporting shaft therethrough, and wherein the mis-assembly device includes:

a plurality of first mis-assembly preventing protrusions formed on an outer peripheral surface of the support shaft; and a corresponding plurality of first mis-assembly preventing holes formed in an outer circumferential portion of the shaft penetrating hole so as to receive the plurality of first mis-assembly preventing protrusions therein.

2. The apparatus of claim 1, wherein the selection member and the selection member guiding member comprise a plurality of pairs of selection members and selection member guiding members, and wherein at least one of positions, shapes and numbers of the plurality of first mis-assembly preventing protrusions and the plurality of first mis-assembly preventing holes formed at each of the pairs of selection members selection member guiding members are different from each other.

3. The apparatus of claim 1, wherein the mis-assembly preventing device further comprises:

a plurality of second mis-assembly preventing protrusions formed on the selection member and spaced apart from the supporting shaft and the plurality of first mis-assembly preventing protrusions formed thereon; and a corresponding plurality of second mis-assembly preventing holes formed in the selection member guiding member and spaced apart from the plurality of first mis-assembly preventing holes so as to receive the plurality of second mis-assembly preventing protrusions therein.

4. The apparatus of claim 3, wherein the selection member and the selection member guiding member comprise a plurality of pairs of selection members and selection member guiding members, and wherein at least one of positions, shapes and numbers of the plurality of second mis-assembly preventing protrusions and the plurality of second mis-assembly preventing holes formed at each of the pairs of selection members and the selection member guiding members are different from each other.

5. The apparatus of claim 4, wherein the transparent window coupling device comprises:

a plurality of selection member windows respectively positioned at a periphery of each of the selection members;

connecting portions that extend between adjacent selection member windows; and window coupling protrusions formed at the connecting portions so to couple the transparent window to the selection member guiding member.

6. The apparatus of claim 1, further comprising a transparent window coupling provided with corresponding portions of the transparent window and the selection member guiding member so as to couple the transparent window and the selection member guiding member.

7. The apparatus of claim 6, wherein mounting holes are formed by mounting hole forming protrusions that protrude from the selection member guiding member.

8. The apparatus of claim 7, wherein mounting portions are provided with locking protrusions locked to the mounting hole forming protrusions so as to fix a state of the selection member at the selection member guiding member.

9. The apparatus of claim 1, wherein the transparent window is formed to encompass the selection member.

10. The apparatus of claim 1, further comprising an elastic member coupled to the selection member so as to provides an elastic force that restores the selection member to an original position.

11. A method of coupling a selection member coupling apparatus for a clothing handler, the selection member coupling apparatus comprising a selection member, a selection member guiding member, a plurality of light emitting devices and a transparent window, the method comprising:

coupling the selection member to the selection member guiding member, comprising inserting a supporting shaft that extends back from a central portion of the selection member into a supporting shaft penetrating hole formed in a corresponding portion of the selection member guiding member; and coupling the transparent window to the selection member guiding member such that the transparent window covers the plurality of light emitting devices.

12. The method of claim 11, wherein the transparent window is coupled to the selection member guiding member after the selection member is coupled to the selection member guiding member.

13. The method of claim 11, wherein coupling the selection member to the selection member guiding member further comprises coupling a plurality of coupling hooks formed on an outer peripheral surface of the supporting shaft to a corresponding plurality of hook coupling holes formed in the selection member guiding member.

14. The method of claim 11, wherein coupling the selection member to the selection member guiding member further comprises coupling a plurality of mis-assembly preventing protrusions formed on the selection member to a corresponding plurality of mis-assembly preventing holes formed in the selection member guiding member.

15. The method of claim 11, wherein coupling the selection member to the selection member guiding member further comprises positioning an elastic member between the selection member and the selection member guiding member so as to provide the selection member with an elastic force.

16. The method of claim 15, wherein positioning the elastic member comprises positioning the supporting shaft formed at the selection member through a center of the elastic member.

17. The method of claim 11, wherein coupling the transparent window to the selection member guiding member comprises mounting a body of the transparent window into mounting holes formed at the selection member guiding member, and locking a plurality of locking protrusions formed at the transparent window into mounting hole forming protrusions formed in the selection member guiding member.

* * * * *